United States Patent [19]

Bregulla et al.

[11] 4,276,834

[45] Jul. 7, 1981

[54] FURNACE FOR INCINERATION OF NUCLEAR FISSION AND FERTILE MATERIAL WASTE PARTICULARLY PLUTONIUM AND URANIUM CONTAINING ORGANIC WASTE

[75] Inventors: Eduard Bregulla, Bruchkobel; Alfred Chrubasik, Neuss; Horst Vietzke, Maintal, all of Fed. Rep. of Germany

[73] Assignee: Nukem G.m.b.H., Hanau, Fed. Rep. of Germany

[21] Appl. No.: 34,184

[22] Filed: Apr. 27, 1979

[30] Foreign Application Priority Data

Apr. 29, 1978 [DE] Fed. Rep. of Germany ..... 2819059

[51] Int. Cl.[3] ..... F23G 7/00; G21F 9/32

[52] U.S. Cl. ..... 110/237; 252/301.1 W

[58] Field of Search ..... 110/235, 237; 252/301.1 W; 366/149, 302, 307

[56] References Cited

U.S. PATENT DOCUMENTS

T939,005 10/1975 Enegess ..... 252/301.1 W 1,711,154 4/1929 Michal ..... 366/307

3,311,457 3/1967 Goosens ..... 366/149

FOREIGN PATENT DOCUMENTS 655125 2/1965 Belgium ..... 252/301.1 W

OTHER PUBLICATIONS

Japanese Abstract 67602 Assigned to Hitachi 9-77.

*Primary Examiner*—James J. Gill

[57] ABSTRACT

There is provided a furnace for incinerating nuclear fission and/or fertile material waste, particularly plutonium and/or uranium containing organic waste by pyrohydrolysis with steam or burning with air oxyen in safe geometry, said furnace comprising in combination a stationary cylindrical outer jacket having a funnel shape at the bottom thereof, a rotatable inner cylinder likewise terminating at the bottom in a funnel shape whose diameter is so regulated that the interval between the outer jacket and the inner cylinder guarantees a safe layer thickness and scrapers which are disposed on the inner surface of the outer jacket and the outer surface of the inner cylinder.

8 Claims, 1 Drawing Figure

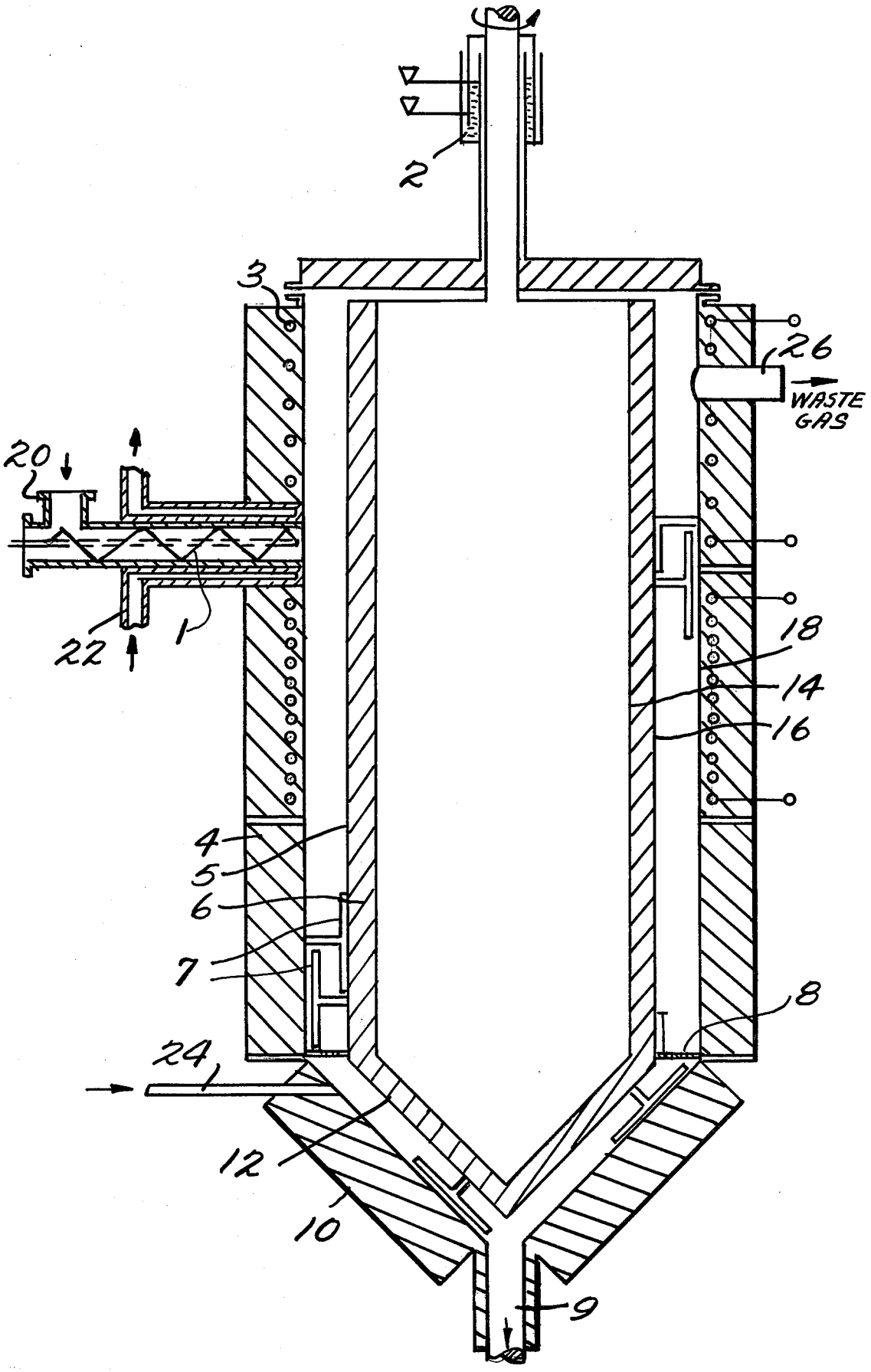
2
3
26
WASTE GAS
20
22
1
18
14
16
4
5
6
7
8
24
12
10
9

FURNACE FOR INCINERATION OF NUCLEAR FISSION AND FERTILE MATERIAL WASTE PARTICULARLY PLUTONIUM AND URANIUM CONTAINING ORGANIC WASTE

BACKGROUND OF THE INVENTION

The invention is directed to a heatable furnace for incinerating nuclear fission and/or fertile material waste, particularly plutonium and/or uranium containing organic waste by pyrohydrolysis with steam or burning with air oxygen in safe geometry.

There are known a series of pyrohydrolysis and combustion furnaces. They are almost exclusively employed for the conventional burning of house refuse. However, for burning of plutonium or uranium containing organic wastes for criticality reasons it is necessary to maintain nuclear safe geometries. To simply reduce the above mentioned conventional furnaces to safe geometry however has proven quite difficult for the following reasons.

1. In the narrow geometry transportation of material and combustion no longer function so that a smaller furnace is susceptible to disturbance.

2. The throughputs attainable are too small for industrial operation.

3. Nuclear fuel penetrates into the pores of the ceramic cladding and increases the nuclear criticality risk.

Thus there has been proposed, for example, for the pyrohydrolytic incineration of organic waste a continuously operating shell gravity discharge furnace (Germain P No. 26 41 264.6). To be sure it is readily possible to make this furnace in criticality safe layer thickness. However, the throughputs then attainable are very low (about 3 kg waste/hr). In the planned German Nuklearen Entsorgungs-zentrum, however from the plutonium operation along 1000–2000 cubic meters of contaminated organic wastes accumulate which correspond to a required plant capacity of about 35 kg/h.

Therefore it was the problem of this invention to design a furnace concept which permits the incineration of nuclear fission and fertile material waste, especially plutonium and/or uranium containing organic waste in safe geometry and on an industrial scale as well as in a safe manner of operation. The furnace should be eminently suited for the endothermal pyrohydrolysis, however, on principle likewise able to be employed for a combustion or pyrolysis.

SUMMARY OF THE INVENTION

This problem was solved according to the invention by using a furnace comprising in combination a stationary cylindrial outer jacket terminating at its lower end in a funnel or conical shape, a rotatable inner cylinder likewise terminating at its lower end in a funnel or conical shape whose diameter is so regulated that the distance between the outer jacket and the inner cylinder guarantees a safe layer thickness and scrapers which are disposed on the inner surface of the outer jacket and the outer surface of the inner cylinder.

The inner cylinder is preferably installed in a manner that it is exchangeable so that according to the waste operated with there can be used the corresponding inner cylinder diameter having the necessary safe layer thickness.

In order to avoid a neutron interaction at high plutonium concentrations the inner cylinder can be coated with neutron absorbing material (e.g. $B_4C$). Besides there can be used as construction material of the furnace at least partially neutron absorbing industrial materials. This furnace concept permits great variations in the layer thickness. According to the provided material inserted the layer thickness can be adjusted from 3.5 to 15 cm, if the inner cylinder is correspondingly changed. Therewith the furnace is suited for both highly enriched grades of U-235 or U-233 and also for high plutonium concentrations.

BRIEF DESCRIPTION OF THE DRAWING

The single FIGURE of the drawing is a sectional view of a furnace according to the invention.

DESCRIPTION OF THE PREFERRED EMBODIMENTS

There is provided a furnace comprising a fixed cylindrical outer jacket 4 reducing in funnel (conical) shape at the bottom 10, in which jacket 4 there is located a heating element 3. Concentrically to this outer jacket 4 there is disposed a rotatable inner cylinder 5 which likewise at its lower end 12 is reduced in funnel (conical) shape and which at the top is held for example by an immersion seal 2. This inner cylinder 5 is preferably double walled, having inner wall 14 and outer wall 16 and is filled with neutron absorption material 6. There are disposed on the turnable inner cylinder 5 and the stationary outer jacket 4 scrapers 7 which continuously scrape off the two walls 16 and 18 of the furnace when the inner cylinder 5 rotates. Therewith the materials introduced for example, via a screw 1 are simultaneously distributed over the entire annular gap and according to the embrittlement (carbonization, incineration) comminuted. Before the furnace space is reduced in funnel shaped manner to the safe cylinder diameter there is provided an annular shaped furnace grate 8 under which the reaction gases are introduced, e.g., through conduit 24. For the pyrohydrolysis this is superheated steam, for incineration (ashing) however, it can also be steam with oxygen or air. For the endothermal pyrohydrolysis it is advantageous to heat the reactive space in order that the amount of superheated steam must not be chosen too large. The radioactive ashes produced are carried out via the collection pipe 9 in critically safe cylinder diameter either continuously or intermittently by means of a valve.

As shown in the drawing $\alpha$-waste is introduced through tube 20 into screw 1. Cooling water is introduced through pipe 22 surrounding screw 1. Waste gas leaves via pipe 26.

The furnace can comprise, consist essentially of the stated parts.

Unless otherwise indicated all parts and percentages are by weight.

The following example further explains the invention:

EXAMPLE

For the pyrohydrolytic incineration of plutonium containing organic wastes having a Pu content of 120 g/m$^3$ (=0.6 gram Pu/kg waste) and a composition of:

| | |
|---|---|
| polyvinyl chloride (PVC) | 50% |
| rubber | 20% |
| cellulose | 15% |
| other synthetic resins | 15% |

-continued

| | |
|---|---|
| density | 200 kg/m$^3$ |

there was employed an annular gap furnace according to the invention as described in the drawings for a throughput of 17.5 kg waste per hour. The velocity of flow was limited to 0.2 m/sec in order to prevent discharge of dust. In order to completely gasify the organic portion with steam at 800° to 1000° C. a maximum residence time of 4 hours was adapted. As shown in the test series the Pu content in the ashes formed was less than or at 1.2%. For the maximum in case of accident it is established that the Pu content in the ashes should not exceed 10%. Under these conditions the annular gas furnace has the following dimensions:

| | |
|---|---|
| inside diameter of the outer jacket | 1000mm |
| outer diameter of the inner cylinder | 780mm |
| annular gap | 110mm |
| inner diameter of the ash cylinder | 100mm |
| length of the reaction zone | 1200mm |

The ashes were removed intermittently (in cans) at the bottom. A neutron absorber under the above conditions is not necessary, for reasons of disturbing conditions a layer of boron carbide powder is arranged as an intermediate layer which here is limited to 80 to 90 mm by the double wall.

For larger diameters of the outer jacket and inner cylinder a throughput of above 35 kg/h can be reached.

There is hereby incorporated by reference the entire disclosure of German priority application P No. 28 19 059.2.

What is claimed is:

1. A furnace especially adapted for incinerating nuclear fission waste and fertile material waste, particularly organic waste containing plutonium or uranium, by pyrohydrolysis with steam or combustion with oxygen in safe geometry, said furnace comprising:

a stationary cylindrical outer jacket terminating at its lower end in the shape of a funnel:

a rotatable inner cylinder coaxially disposed within said jacket and also terminating at its lower end in the shape of a funnel to define, with said jacket, an annular gap therebetween, the wall of said inner cylinder being provided with material especially adapted to absorb neutrons, the diameter of said inner cylinder being so regulable that said annular gap guarantees a safe layer thickness; and scrapers for the outer surface of said cylinder and the inner surface of said jacket secured respectively to the inner side of said jacket and the outer side of said cylinder.

2. A furnace according to claim 1 wherein the inner cylinder is removably mounted.

3. A furnace according to claim 2 wherein the inner cylinder is double walled with a space there between, said space being filled with neutron absorbing material.

4. A furnace according to claim 3 wherein the neutron absorbing material is boron carbide.

5. A furnace according to claim 1 wherein the inner cylinder is double walled with a space therebetween, said space being filled with a neutron absorbing material.

6. A furnace according to claim 1 wherein the furnace is made at least in part of neutron absorbing material.

7. A furnace according to claim 6 wherein the outer jacket is provided with heating means.

8. A furnace according to claim 1 having:

a grate adjacent the lower end of the annular gap above its funnel shaped portion, conduit means for supplying gas to said annular gap below said grate, conduit means for removing ash from the lower end of said funnel shaped portion of said gap;

screw conveying means for supplying waste to the upper portion of said annular gap above said grate, conduit means for removing waste gas from said upper portion of said gap, and cooling means for externally cooling said screw conveying means.

* * * * *